US009244409B2

(12) United States Patent
Kondo

(10) Patent No.: US 9,244,409 B2
(45) Date of Patent: Jan. 26, 2016

(54) FIXING DEVICE HAVING NIP MEMBER WITH ELASTIC LAYER

(71) Applicant: Brother Kogyo Kabushiki Kaisha, Nagoya-shi, Aichi-ken (JP)

(72) Inventor: Tomohiro Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/497,537

(22) Filed: Sep. 26, 2014

(65) Prior Publication Data

US 2015/0093165 A1 Apr. 2, 2015

(30) Foreign Application Priority Data

Sep. 30, 2013 (JP) ..... 2013-203224

(51) Int. Cl.
*G03G 15/20* (2006.01)

(52) U.S. Cl.
CPC ..... *G03G 15/206* (2013.01); *G03G 15/2028* (2013.01); *G03G 2215/2016* (2013.01); *G03G 2215/2035* (2013.01); *G03G 2215/2041* (2013.01); *G03G 2215/2048* (2013.01)

(58) Field of Classification Search
CPC ..... G03G 15/2028; G03G 15/206; G03G 2215/2016; G03G 2215/2035; G03G 2215/2041; G03G 2215/2048
See application file for complete search history.

(56) References Cited

U.S. PATENT DOCUMENTS

| | | | | |
|---|---|---|---|---|
| 5,210,579 | A | 5/1993 | Setoriyama et al. | |
| 5,401,936 | A | 3/1995 | Kusaka et al. | |
| 6,505,027 | B2 | 1/2003 | Takeuchi et al. | |
| 2001/0022909 | A1 | 9/2001 | Takeuchi et al. | |
| 2006/0216077 | A1* | 9/2006 | Komuro | 399/328 |
| 2007/0292175 | A1* | 12/2007 | Shinshi | 399/329 |
| 2012/0107029 | A1* | 5/2012 | Moon et al. | 399/329 |
| 2012/0275831 | A1* | 11/2012 | Ishida et al. | 399/329 |

FOREIGN PATENT DOCUMENTS

| | | | |
|---|---|---|---|
| JP | H03-263073 | A | 11/1991 |
| JP | H04-204980 | A | 7/1992 |
| JP | 2001-215767 | A | 8/2001 |

* cited by examiner

*Primary Examiner* — Ryan Walsh
(74) *Attorney, Agent, or Firm* — Banner & Witcoff, Ltd.

(57) ABSTRACT

A fixing device includes: a tubular endless belt, a heater, a nip member, an elastic layer and a backup member. The endless belt has an inner peripheral surface defining an internal space and is configured to circularly move in a moving direction. The heater is disposed in the internal space and is configured to generate radiant heat. The nip member is disposed in the internal space and spaced away from the heater. The elastic layer is fixed on the nip member and positioned between the nip member and the inner peripheral surface of the endless belt. The backup member and the nip member are configured to nip the tubular endless belt therebetween to provide a nip region between the backup member and the nip member.

19 Claims, 11 Drawing Sheets

FIXING DEVICE HAVING NIP MEMBER WITH ELASTIC LAYER

CROSS REFERENCE TO RELATED APPLICATION

This application claims priority from Japanese Patent Application No. 2013-203224 filed Sep. 30, 2013. The entire content of the priority application is incorporated herein by reference.

TECHNICAL FIELD

The present invention relates to a fixing device that thermally fixes a transferred developing agent image to a sheet.

BACKGROUND

Japanese Patent Application Publication No. 2001-215767 discloses a thermal fixing device provided with an endless fixing belt of a tubular shape, and a heating element disposed in an internal space of the fixing belt. The tubular fixing belt has an inner peripheral surface that is totally covered with a rubber layer.

SUMMARY

In the above-described fixing device, the rubber layer covers the entire inner peripheral surface of the fixing belt. Since rubber has a relatively high heat capacity, the rubber layer prevents a temperature of the fixing belt from rising readily, possibly result in fixing malfunctions.

In view of the foregoing, it is an object of the present invention to provide a fixing device that realizes prompt rise in temperature of a fixing belt and improved fixing performance by reducing heat capacity of a rubber layer (elastic layer).

In order to attain the above and other objects, there is provided a fixing device that may include a tubular endless belt, a heater, a nip member, an elastic layer and a backup member. The tubular endless belt has an inner peripheral surface defining an internal space and is configured to circularly move in a moving direction. The heater is disposed in the internal space and is configured to generate radiant heat. The nip member is disposed in the internal space and spaced away from the heater. The elastic layer is fixed on the nip member and positioned between the nip member and the inner peripheral surface of the tubular endless belt. The backup member and the nip member are configured to nip the tubular endless belt therebetween to provide a nip region between the backup member and the nip member.

According to another aspect of the present invention, there is provided a fixing device that may include an endless belt, a heater, a nip member spaced away from the heater, and a backup member. The backup member and the nip member nip the endless belt therebetween. The nip member includes a base layer and an elastic layer. The elastic layer is fixed on the base layer and is in contact with the endless belt.

DETAILED DESCRIPTION

1. First Embodiment

First, a general configuration of a laser printer 1 provided with a fixing device 100 according to a first embodiment of the present invention will be described with reference to FIG. 1.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side are to be referred to as a front side, a rear side, a left side and a right side, respectively. Further, a vertical direction in FIG. 1 will be referred to as an up-down direction (or simply vertical direction) with respect to the laser printer 1.

<General Construction of the Laser Printer>

Figure 1:
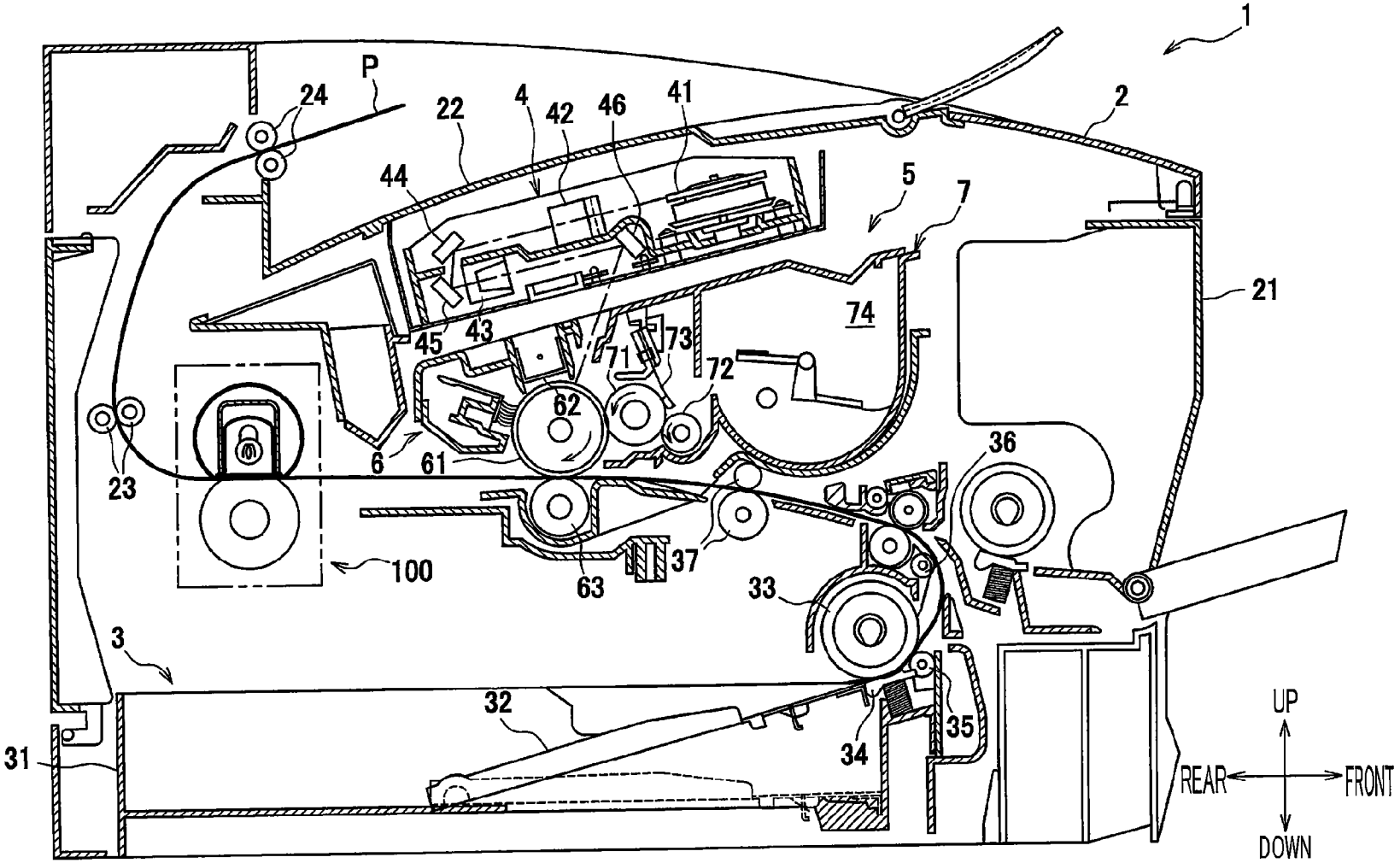
FIG. 1 is a schematic cross-sectional view showing a general configuration of a laser printer provided with a fixing device according to a first embodiment of the present invention.

As shown in FIG. 1, the laser printer 1 includes a main frame 2 provided with a movable front cover 21 at the front side. Within the main frame 2, provided are a sheet supply unit 3 for supplying a plurality of sheets P, an exposure unit 4, a process cartridge 5 for transferring a toner image (developing agent image) onto each sheet P, and the fixing device 100 for thermally fixing the toner image onto the sheet P.

The sheet supply unit 3 is disposed at a lower portion of the main frame 2. The sheet supply unit 3 includes a sheet supply tray 31 for accommodating the sheets P, a lifter plate 32 for lifting up a front side of each sheet P, a sheet supply roller 33, a sheet supply pad 34, paper dust removing rollers 35, 36, and a pair of registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 after passing through the paper dust removing rollers 35, 36, and the registration rollers 37.

The exposure unit 4 is disposed at an upper portion of the main frame 2. The exposure unit 4 includes a laser emission unit (not shown), a polygon mirror 41, lenses 42, 43, and reflection mirrors 44, 45, 46. In the exposure unit 4, the laser emission unit emits a laser beam (indicated by a dotted line in FIG. 1) based on image data. The laser beam is then reflected by or passes through the polygon mirror 41, the lens 42, the reflection mirrors 44, 45, the lens 43, and the reflection mirror 46 in this order to expose a surface of a photosensitive drum 61 to light at a high speed.

The process cartridge 5 is disposed below the exposure unit 4. The process cartridge 5 is detachably loadable into the main frame 2 through a front opening defined when the front cover 21 is opened. The process cartridge 5 includes a drum unit 6 and a developing unit 7.

The drum unit 6 includes the photosensitive drum 61, a charger 62, and a transfer roller 63. The developing unit 7 is detachably mountable on the drum unit 6. The developing unit 7 includes a developing roller 71, a toner supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is then conveyed between the developing roller 71 and the thickness-regulation blade 73 so as to be carried on the developing roller 71 as a thin layer having a uniform thickness.

The toner borne on the developing roller 71 is supplied to the electrostatic latent image formed on the photosensitive drum 61. Hence, a visible toner image corresponding to the electrostatic latent image is formed on the photosensitive drum 61. When the sheet P is then being conveyed between the photosensitive drum 61 and the transfer roller 63, the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 and is discharged onto a discharge tray 22 formed on an upper surface of the main frame 2.

<Detailed Structure of the Fixing Device>

The fixing device 100 according to the first embodiment of the present invention will be described with reference to FIGS. 2A and 2B.

Figure 2A:
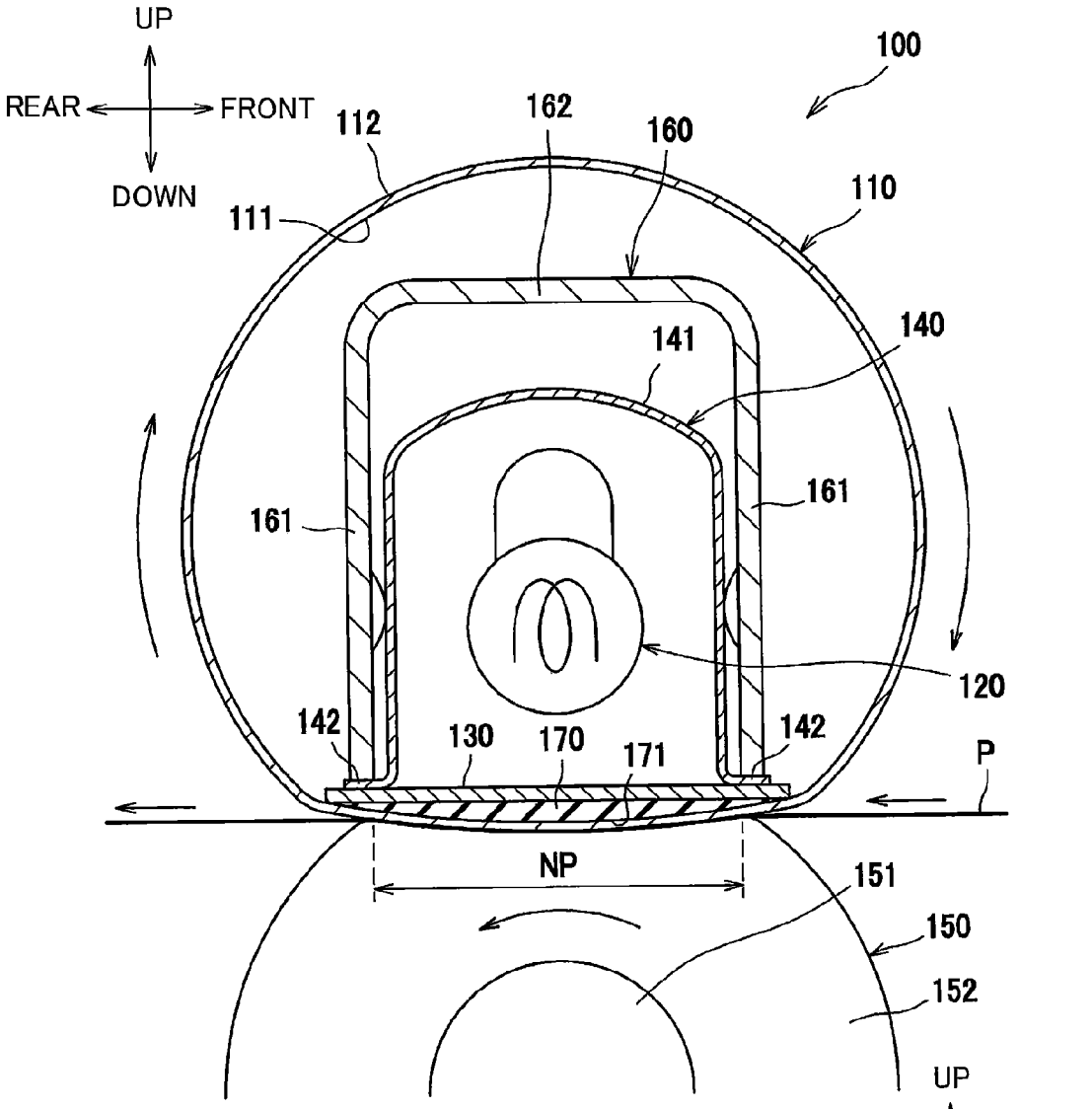
FIG. 2A is a cross-sectional view of the fixing device according to the first embodiment taken along a plane perpendicular to a left-right direction.

As shown in FIG. 2A, the fixing device 100 includes a fixing belt 110 as an example of a tubular endless belt, a halogen lamp 120 as an example of a heater, a nip plate 130 as an example of a nip member, a reflection plate 140, a stay 160 and a pressure roller 150 as an example of a backup member.

The fixing belt 110 is an endless belt of a tubular configuration having flexibility and heat-resistivity. The fixing belt 110 includes a metal base tube and a fluorocarbon resin covering the metal base tube. The metal base tube is made of a metal such as stainless steel. The fixing belt 110 has an inner peripheral surface 111 and an outer peripheral surface 112. The fixing belt 110 is configured to circularly move in a direction indicated by an arrow in FIG. 2A. Thus, the inner peripheral surface 111 is configured to move in sliding contact with the nip plate 130, whereas the outer peripheral surface 112 is configured to move in sliding contact with the pressure roller 150. Moreover, the inner peripheral surface 111 of the fixing belt 110 is applied with a lubricant.

The halogen lamp 120 is a heater configured to radiate radiant heat. The halogen lamp 120 is positioned at an internal space of the fixing belt 110 and is spaced away from an inner surface of the nip plate 130 by a predetermined distance. The halogen lamp 120 is configured to heat the fixing belt 110 indirectly via the nip plate 130 for heating toner on the sheet P.

The nip plate 130 is a substantially flat plate-like member elongated in a left-right direction. The nip plate 130 is disposed to be in sliding contact with the inner peripheral surface 111 of the tubular fixing belt 110. The nip plate 130 has an upper surface that faces the halogen lamp 120. The nip plate 130 is configured to transfer the radiant heat from the halogen lamp 120 to the toner on the sheet P through the fixing belt 110.

The nip plate 130 is made from a material such as aluminum having a thermal conductivity higher than that of the stay 160 (described later) made from a steel. Incidentally, the surface of the nip plate 130 that is in contact with the inner peripheral surface 111 of the fixing belt 110 may be coated with, for example, a metal oxide film or a fluorocarbon resin layer. Preferably, the nip plate 130 has a thickness of between 0.1 mm and 10 mm, and more preferably between 0.5 mm and 1 mm.

In FIG. 2A, the sheet P is configured to be fed from the front to the rear. This direction in which the sheet P is conveyed will be referred to as a sheet conveying direction, hereinafter.

The nip plate 130 has a lower surface on which a rubber layer 170 is provided as an example of an elastic layer. The rubber layer 170 is provided to ensure a sufficient area for nipping the sheet P between the nip plate 130 and the pressure roller 150. As shown in FIGS. 2A and 2B, the rubber layer 170 is formed to cover the entire lower surface of the nip plate 130. Incidentally, the rubber layer 170 may be fixed to the nip plate 130 using an adhesive agent, or may be provided integrally with the nip plate 130 using an insert molding. A material for forming the rubber layer 170 may have a heat resistant temperature higher than a temperature of the fixing belt 110 or the nip plate 130 during thermal fixation of the sheet P at the fixing device 100 (i.e., maximum temperature of the fixing belt 110 or the nip plate 130 that can be reached at the time of thermal fixation). For instance, fluoro-rubber and silicone rubber are available as rubber with high heat resistance.

The rubber layer 170 has a thickness which is largest in a central portion in the front-rear direction (in the sheet conveying direction). The thickness of the rubber layer 170 gradually becomes smaller, from the central portion, toward upstream in the sheet conveying direction, and also toward downstream in the sheet conveying direction. Specifically, the rubber layer 170 has a lower surface that functions as a sliding contact surface 171 configured to slidingly contact the inner peripheral surface 111 of the fixing belt 110 in the first embodiment. The sliding contact surface 171 has an arcuate shape protruding downward (toward the pressure roller 150) when viewed in the left-right direction (i.e., a widthwise direction of the fixing belt 110), as shown in FIG. 2A.

Incidentally, the rubber layer 170 has a maximum thickness of preferably within a range of 50 μm to 1000 μm, more preferably within a range of 100 μm to 500 μm, and most preferably within a range of 120 μm to 200 μm.

Figure 2B:
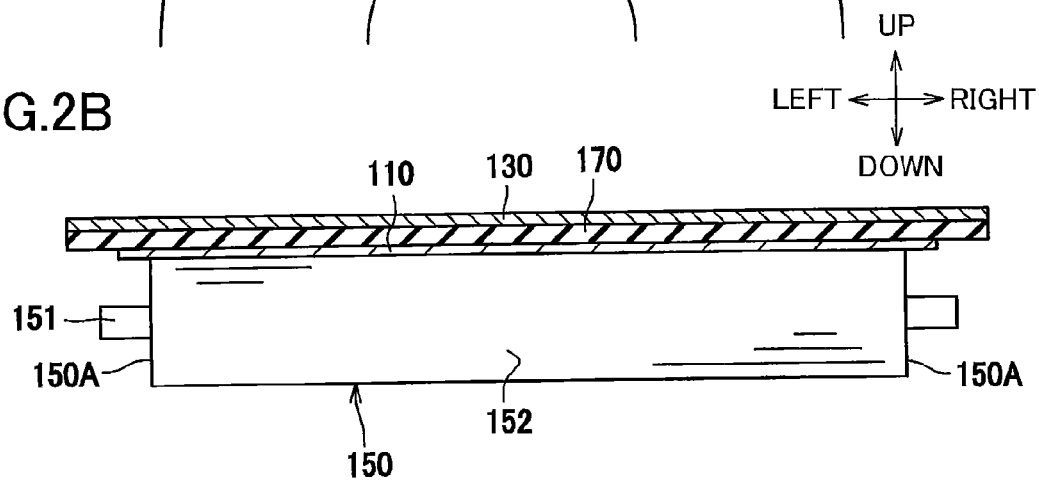
FIG. 2B is a cross-sectional view of the fixing device according to the first embodiment taken along a plane perpendicular to a front-rear direction.

As shown in FIG. 2B, the rubber layer 170 is longer than the pressure roller 150 in the left-right direction. That is, the rubber layer 170 has end portions positioned outward of respective end portions 150A of the pressure roller 150 (end portions of a rubber portion 152 of the pressure roller 150, as described later) in the left-right direction. Incidentally, the fixing belt 110 has a width smaller than that of the rubber layer 170 but larger than that of the pressure roller 150 in the left-right direction.

The rubber layer 170 is made of a more rigid material (material that is less likely to deform) than the rubber portion 152 of the pressure roller 150. In this way, the sliding contact surface 171 of the rubber layer 170 can maintain its arcuate shape in cross-section in a state where the pressure roller 150 and the rubber layer 170 nip the fixing belt 110 therebetween.

As shown in FIG. 2A, the reflection plate 140 is configured to reflect the radiant heat from the halogen lamp 120 toward the nip plate 130. The reflection plate 140 is positioned at the internal space of the fixing belt 110, more specifically between the halogen lamp 120 and the stay 160 (described later) to surround the halogen lamp 120, with a predetermined distance therefrom. Thus, the radiant heat from the halogen lamp 120 can be efficiently concentrated onto the nip plate 130 to promptly heat the nip plate 130 and the fixing belt 110.

The reflection plate 140 is configured into U-shape in cross-section and is made from a material such as aluminum having high reflection ratio regarding infrared ray and far infrared ray. Specifically, the reflection plate 140 has a U-shaped reflection portion 141 and a pair of flange portions 142 one extending from each end portion of the reflection portion 141 in the front-rear direction. A mirror surface finishing is available on a surface of the aluminum reflection plate 140 for specular reflection in order to enhance heat reflection ratio.

The stay 160 is adapted to support both front and rear end portions of the nip plate 130 via the flange portions 142 of the reflection plate 140 for maintaining rigidity of the nip plate 130. The stay 160 is positioned opposite to a nip portion NP (described later) with respect to the nip plate 130. The stay 160 has a U-shape configuration in conformity with an outer shape of the reflection portion 141 to cover the reflection plate 140. For fabricating the stay 160, a highly rigid member such as a steel plate is folded into U-shape. At the nip portion NP, the sheet conveying direction is coincident with the moving direction of the fixing belt 110.

The stay 160 includes a pair of first walls 161 and a second wall 162. The pair of first walls 161 is disposed to face each other in the front-rear direction. The second wall 162 connects respective upper end portions of the first walls 161 and is integrally formed with the first walls 161.

The pressure roller 150 is positioned below the nip plate 130 to oppose the outer peripheral surface 112 of the fixing belt 110 in the vertical direction. The pressure roller 150 includes a metal shaft 151 and the rubber portion 152. The metal shaft 151 defines an axis extending in the left-right direction and the pressure roller 150 is rotatable about this axis. The rubber portion 152 is provided over the metal shaft 151 to cover an outer peripheral surface of the metal shaft 151. The rubber portion 152 is made of a material having elasticity and thus the rubber portion 152 is elastically deformable. The pressure roller 150 is configured to nip the fixing belt 110 in cooperation with the nip plate 130 in a state where the rubber portion 152 is elastically deformed, such that the nip portion NP is provided between the pressure roller 150 and outer peripheral surface 112 of the fixing belt 110 for nipping the sheet P therebetween.

The pressure roller 150 is rotationally driven by a drive motor (not shown) disposed in the main frame 2. By the rotation of the pressure roller 150, the fixing belt 110 is configured to be circularly moved along the nip plate 130 because of a friction force generated therebetween or between the sheet P and the fixing belt 110. A toner image on the sheet P can be thermally fixed thereto by heat and pressure during passage of the sheet P at the nip portion NP between the pressure roller 150 and the fixing belt 110.

Incidentally, in order to provide the nip portion NP between the pressure roller 150 and the fixing belt 110, the pressure roller 150 may be biased toward the nip plate 130, or alternatively the nip plate 130 may be urged toward the pressure roller 150.

The fixing device 100 according to the first embodiment can provide the following technical advantages and effects.

Providing the rubber layer 170 on the nip plate 130 can render heat capacity of the rubber layer 170 smaller, in comparison to a structure where a rubber layer is provided on an entire inner peripheral surface of a fixing belt. Therefore, the temperature of the fixing belt 110 can be rapidly increased, leading to enhanced fixing performance at the fixing device 100.

The nip plate 130 and the halogen lamp 120 are disposed to be separated from each other. Thus, the radiant heat from the halogen lamp 120 can heat the entire nip plate 130 substantially uniformly, and the rubber layer 170 in contact with the substantially uniformly heated nip plate 130 can be heated satisfactorily.

Since the sliding contact surface 171 of the rubber layer 170 has an arcuate shape that is convex downward, sliding resistance between the rubber layer 170 and the fixing belt 110 can be reduced, and the fixing belt 110 can circularly move smoothly.

The left and right end portions of the rubber layer 170 are positioned outward than the end portions 150A of the pressure roller 150 in the left-right direction. This means that the fixing belt 110 can be prevented from bending about corners of the left and right end portions of the rubber layer 170. Durability of the fixing belt 110 can be thus improved. In contrast, in a comparative example where a rubber layer has left and right ends positioned inward than widthwise ends of the pressure roller in the left-right direction, the fixing belt interposed between the rubber layer and the pressure roller may possibly bend about corners of the left and right ends of the rubber layer, and durability of the fixing belt could deteriorate.

In the nip plate 130 of the first embodiment, the thickness of the rubber layer 170 gradually decreases from its central portion toward upstream in the sheet conveying direction. In other words, the thin portion of the rubber layer 170, whose temperature tends to rise more readily than the thick portion, is positioned upstream in the sheet conveying direction. With this structure, thermal fixation of the toner image to the sheet P can be performed readily at the thin portion before the toner image reaches the thick portion of the rubber layer 170. Further, since the thickness of the rubber layer 170 gradually decreases from the central portion toward upstream in the sheet conveying direction, the sheet P can smoothly enter into the nip portion NP.

Further, since the lubricant is applied to the inner peripheral surface 111 of the fixing belt 110, this lubricant enables the fixing belt 110 to smoothly move relative to the rubber layer 170.

2. Second Embodiment

Figure 3A:
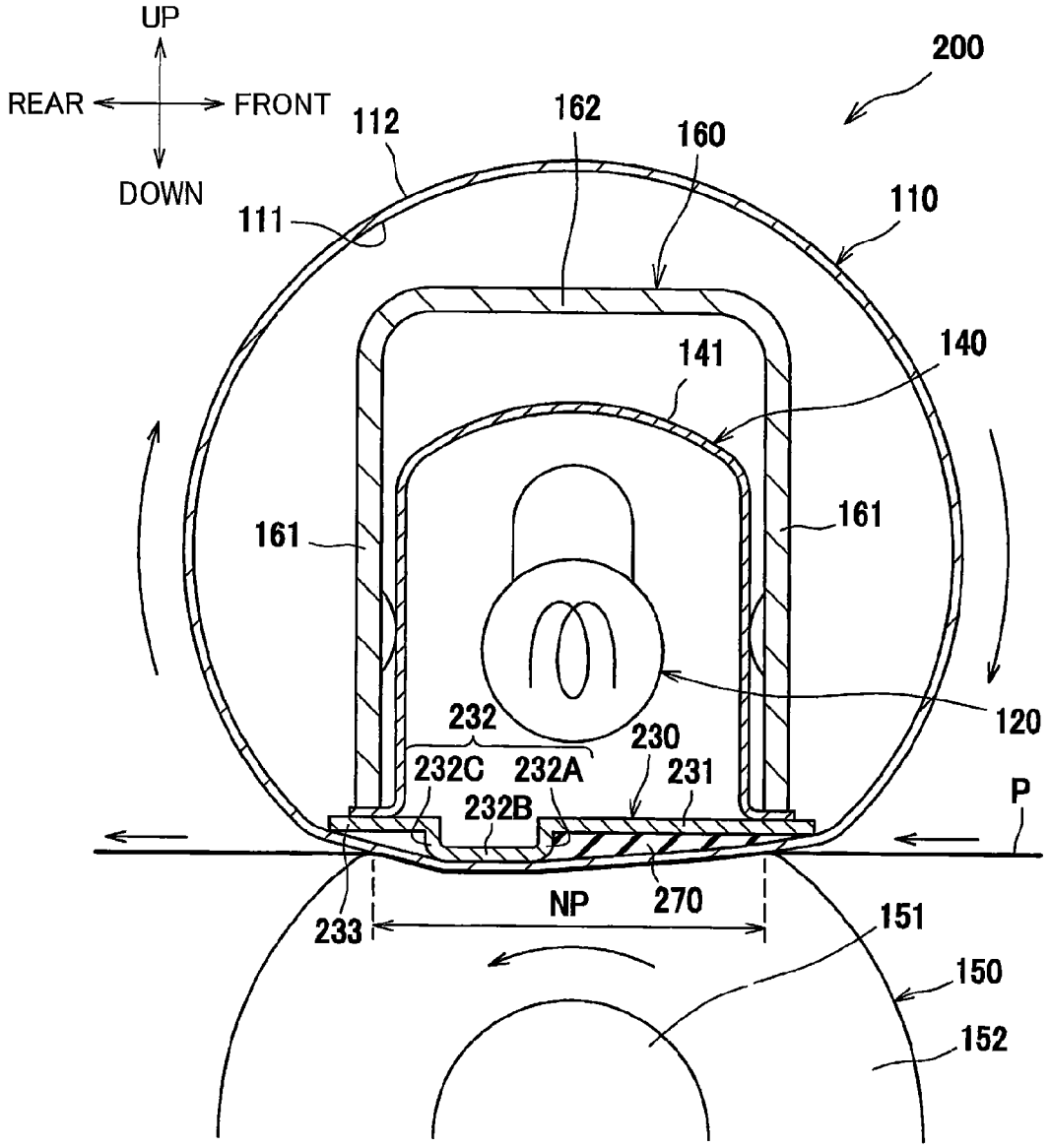
FIG. 3A is a cross-sectional view of a fixing device according to a second embodiment.

A fixing device 200 according to a second embodiment of the present invention will now be described with reference to FIGS. 3A and 3B, wherein like parts and components are designated with the same reference numbers with those of the first embodiment to avoid duplicating description.

The fixing device 200 of the second embodiment includes a nip plate 230 provided with a rubber layer 270. Specifically, the nip plate 230 includes a supporting portion 231 supporting the rubber layer 270, a protruding portion 232, and a non-supporting portion 233 positioned opposite to the supporting portion 231 with respect to the protruding portion 232. The protruding portion 232 is an example of a first protruding portion.

The supporting portion 231 is a plate-shaped portion elongated in the left-right direction. The supporting portion 231 is positioned upstream of the protruding portion 232 in the moving direction of the fixing belt 110 (sheet conveying direction). The supporting portion 231 supports an upper surface (as an example of a second surface) of the rubber layer 270. The supporting portion 231 is positioned at the same height as the non-supporting portion 233 with respect to the up-down direction.

The protruding portion 232 has a U-shape in a cross-sectional view and is positioned between the supporting portion 231 and the non-supporting portion 233 in the moving direction of the fixing belt 110. The protruding portion 232 is formed to span between left and right ends of the supporting portion 231 in the left-right direction. The protruding portion 232 is a portion protruding downward (toward the pressure roller 150) from a rear end of the supporting portion 231 and from a front end of the non-supporting portion 233. That is, the protruding portion 232 is connected to the supporting portion 231 and the non-supporting portion 233.

Specifically, the protruding portion 232 has an upstream wall 232A, a bottom wall 232B and a downstream wall 232C. The upstream wall 232A extends downward from the rear end of the supporting portion 231 (a downstream end portion of the supporting portion 231 in the sheet conveying direction). The bottom wall 232B extends downstream from a lower end of the upstream wall 232A in the sheet conveying direction. The downstream wall 232C extends upward from a downstream end portion of the bottom wall 232B in the sheet conveying direction.

The bottom wall 232B has a planar lower surface that is orthogonal to the vertical direction. Corner portions of the bottom wall 232B (upstream and downstream end portions of the bottom wall 232B in the sheet conveying direction) are formed in an arcuate shape in a cross-sectional view. The bottom wall 232B has a front-rear length (width) of approximately one-third that of the nip portion NP. Preferably, the front-rear length (width) of the bottom wall 232B is approximately one-half of that of the nip portion NP, and more preferably approximately one-third of that of the nip portion NP.

Provision of the protruding portion 232 can lead to enlargement of a region used for heating the fixing belt 110, thereby enabling the protruding portion 232 to effectively and satisfactorily heat the fixing belt 110.

The non-supporting portion 233 extends downstream from an upper end of the downstream wall 232C of the protruding portion 232.

Figure 3B:
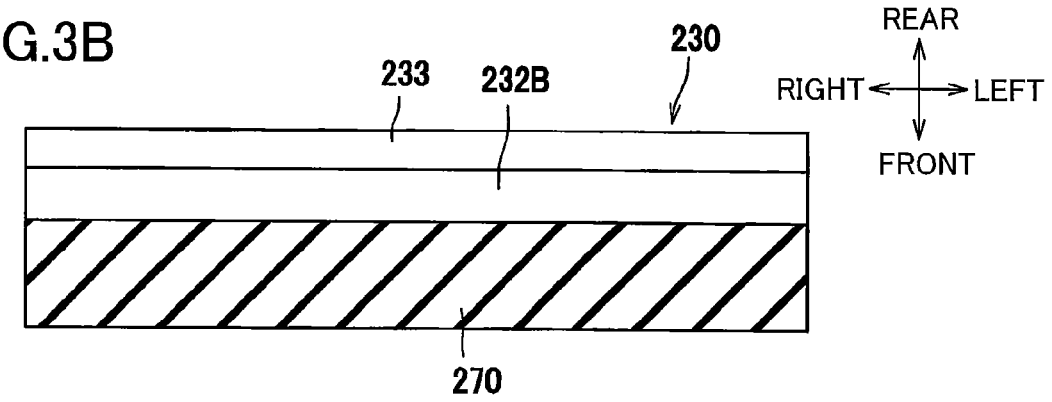
FIG. 3B is a bottom view of a nip plate of the fixing device according to the second embodiment as viewed from a pressure roller.

The rubber layer 270 is provided to cover the entire lower surface of the supporting portion 231, as shown in FIG. 3B. The rubber layer 270 has a lower surface configured to be in sliding contact with the inner peripheral surface 111 of the fixing belt 110. The lower surface of the rubber layer 270 is an example of a first surface. The rubber layer 270 is positioned upstream of the protruding portion 232 and is in contact with the upstream wall 232A of the protruding portion 232 in the moving direction of the fixing belt 110. By providing the rubber layer 270 in contact with the protruding portion 232 in this way, heat can be applied to the rubber layer 270 from both the supporting portion 231 and the protruding portion 232, thereby enabling the rubber layer 270 to be heated quickly.

The thickness of the rubber layer 270 becomes gradually smaller toward upstream in the moving direction of the fixing belt 110. With this structure, the technical advantage the same as that in the first embodiment can be also be achieved in the second embodiment. That is, the toner image can be thermally fixed to the sheet P at the thin portion of the rubber layer 170, and the sheet P can be inserted smoothly into the nip portion NP.

3. Third Embodiment

A fixing device 300 according to a third embodiment of the present invention will now be described with reference to FIGS. 4A and 4B, wherein like parts and components are designated with the same reference numbers with those of the foregoing embodiments to avoid duplicating description.

The fixing device 300 of the third embodiment includes a nip plate 330. Specifically, the nip plate 230 has a supporting portion 331, a protruding portion 332, and a non-supporting portion 333. The supporting portion 331 and non-supporting portion 333 of the third embodiment have generally the same structures as those of the supporting portion 231 and non-supporting portion 233 of the second embodiment. The protruding portion 332 also has the same structure as that of the protruding portion 232 of the second embodiment. The protruding portion 332 thus includes the upstream wall 232A, bottom wall 232B and downstream wall 232C as in the second embodiment. However, in contrast to the second embodiment, the supporting portion 331 is positioned downstream of the protruding portion 332, and the non-supporting portion 333 is positioned upstream of the protruding portion 332 in the sheet conveying direction. The protruding portion 332 is another example of the first protruding portion.

Specifically, the supporting portion 331 extends toward downstream in the moving direction of the fixing belt 110 from an upper end portion of the downstream wall 232C of the protruding portion 332. An elastic layer 370 having the similar structure as the elastic layer 270 is provided at a lower surface of the supporting portion 331 so as to be in contact with the downstream wall 232C. The non-supporting portion 333 extends toward upstream the moving direction of the fixing belt 110 from an upper end portion of the upstream wall 232A of the protruding portion 332. The non-supporting portion 333 has an upstream end portion that is positioned farther upstream than the stay 160 in the moving direction of the fixing belt 110.

The upstream end portion of the non-supporting portion 333 has an upper surface on which a temperature detector T disposed. In other words, a portion of the upstream end portion of the non-supporting portion 333 that opposes the temperature detector T constitutes a detected portion 333A whose temperature is detected by the temperature detector T.

Figure 4A:
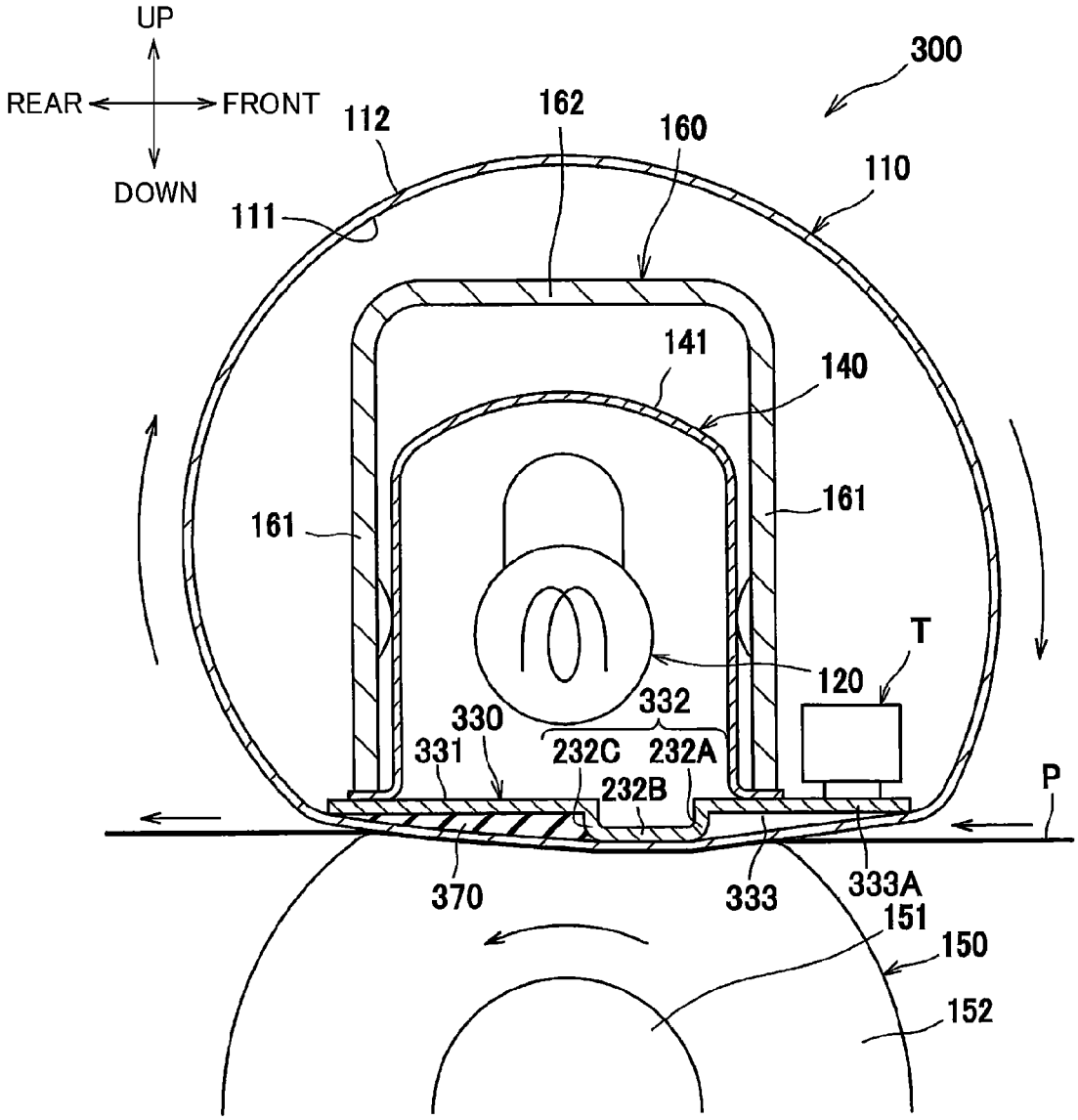
FIG. 4A is a cross-sectional view of a fixing device according to a fourth embodiment.
Figure 4B:
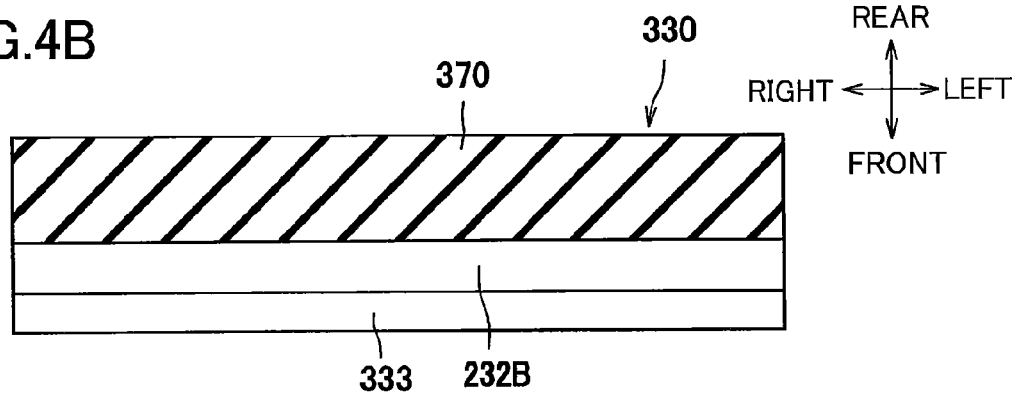
FIG. 4B is a bottom view of a nip plate of the fixing device according to the fourth embodiment as viewed from the pressure roller.

Referring to FIG. 4A, the detected portion 333A is positioned opposite to the supporting portion 331 with respect to the protruding portion 332. With this structure, heat from the protruding portion 332 is conveyed to the detected portion 333A without having to pass through the supporting portion 331 supporting the rubber layer 370. Thus the temperature detector T can accurately detect the temperature of the nip portion NP at the protruding portion 332.

Incidentally, the temperature detector T may be supported by, for example, a cover member (not shown) covering the stay 160. Further, as the temperature sensor T, either a non-contact type or a contact-type thermostat or thermistor is available.

Referring to FIG. 4A, the rubber layer 370 is positioned downstream of the protruding portion 332 in the moving direction of the fixing belt 110. In other words, the protruding portion 332 is disposed upstream of the rubber layer 370 in the moving direction of the fixing belt 110 (or in the sheet conveying direction). For this reason, the toner image on the sheet P can be thermally fixed by the upstream-positioned protruding portion 332, which can realize more rapid heat elevation than the rubber layer 370, before the toner image on the sheet P reaches the rubber layer 370. Furthermore, even if the toner on the sheet P were to be reverse-transferred to the fixing belt 110 during thermal fixation of the toner image at the protruding portion 332, the fixing belt 110 would be subsequently pressed against the pressure roller 150 due to high pressure applied by the rubber layer 370, thereby satisfactorily suppressing such reverse transfer.

Further, the rubber layer 370 is in contact with the downstream wall 232C of the protruding portion 332. Hence, the same effect as with the second embodiment can be realized. That is, the rubber layer 370 can be heated promptly.

Further, the rubber layer 370 has a thickness which gradually decreases toward downstream in the sheet conveying direction. By making the rubber layer 270 thinner toward its downstream side, sliding resistance against the fixing belt 110 can be reduced, thereby improving separability of the sheet P from the fixing belt 110.

Since the rubber layer 370 becomes thinner toward downstream in the sheet conveying direction, sliding resistance of the rubber layer 370 against the fixing belt 110 can be reduced, and thus a downstream portion of the rubber layer 370 does not undergo significant deformation. This means that the rubber layer 370 is less susceptible to a restoration force that the rubber layer 370 tries to restore its original shape after having been significantly deformed. Therefore, the fixing belt 110 is prevented from being pressed strongly against the sheet P by the restoration force of the rubber layer 370, and the separability of the sheet P relative to the fixing belt 110 can be improved.

4. Fourth Embodiment

Figure 5A:
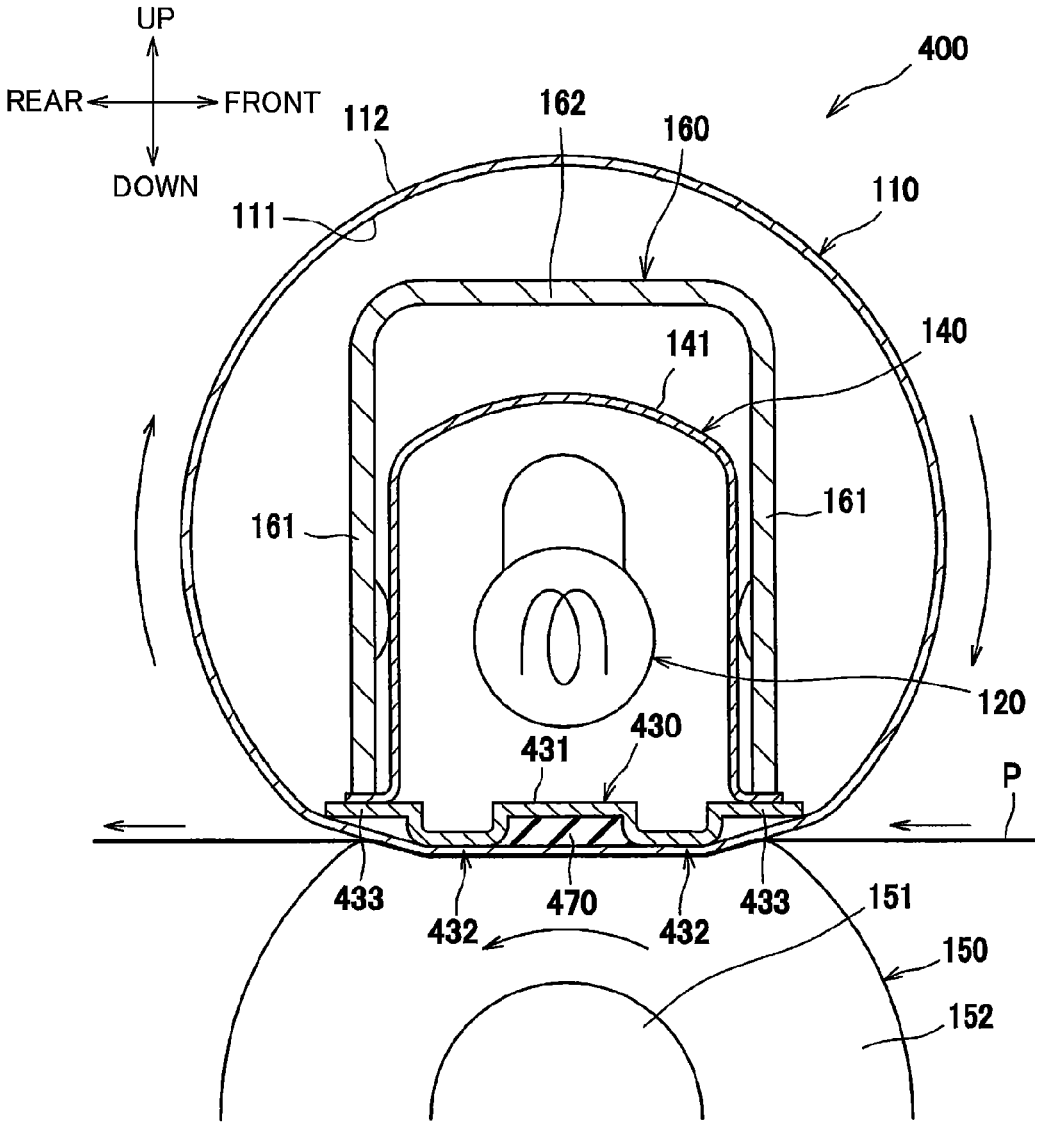
FIG. 5A is a cross-sectional view of a fixing device according to a second embodiment.
Figure 5B:
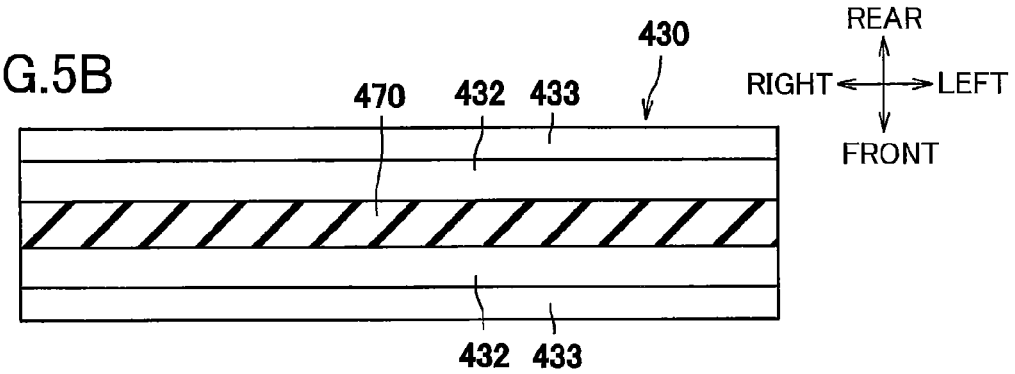
FIG. 5B is a bottom view of a nip plate of the fixing device according to the second embodiment as viewed from the pressure roller.

A fixing device 400 according to a fourth embodiment of the present invention will now be described with reference to FIGS. 5A and 5B.

The fixing device 400 of the fourth embodiment includes a nip plate 430. As shown in FIGS. 5A and 5B, the nip plate 430 has a supporting portion 431, a pair of protruding portions 432, and a pair of non-supporting portions 433. The supporting portion 431 has substantially similar structure to that of the supporting portion 231 of the second embodiment, but is located at a central portion of the nip plate 430 in the sheet conveying direction. Each protruding portions 432 has substantially the same structure as that of the protruding portion 232 in the second embodiment. The protruding portions 432 are respectively positioned upstream of and downstream of the supporting portion 431 in the moving direction of the endless belt 110. The non-supporting portions 433 have substantially the similar structure as the supporting portion 233 of the second embodiment, and are located outside of the respective protruding portions 432 in the front-rear direction. That is, one non-supporting portion 433 is positioned at upstream of the front protruding portion 432, and the other non-supporting portion 433 is positioned at downstream of the rear protruding portion 432 in the sheet conveying direction. The protruding portions 432 are examples of the first protruding portion and a second protruding portion.

The supporting portion 431, which is positioned between the pair of protruding portions 432, has a lower surface at which a rubber layer 470 is provided. The rubber layer 470 is positioned between the protruding portions 432. With the rubber layer 470 nipped between the protruding portions 432 in this way, the rubber layer 470 can be reliably suppressed from peeling away from the nip plate 430. Further, since one of the protruding portions 432 is disposed upstream of the rubber layer 470, the toner image can be reliably thermally fixed to the sheet P by this upstream-positioned (front) protruding portion 432 before the toner image reaches the rubber layer 470.

Further, the rubber layer 470 is in contact with both of the protruding portions 432 whose temperature tends to rise readily. Thus heat from the protruding portions 432 can be reliably transmitted to the rubber layer 470 to realize rapid heating of the rubber layer 470.

5. Fifth Embodiment

Figure 6:
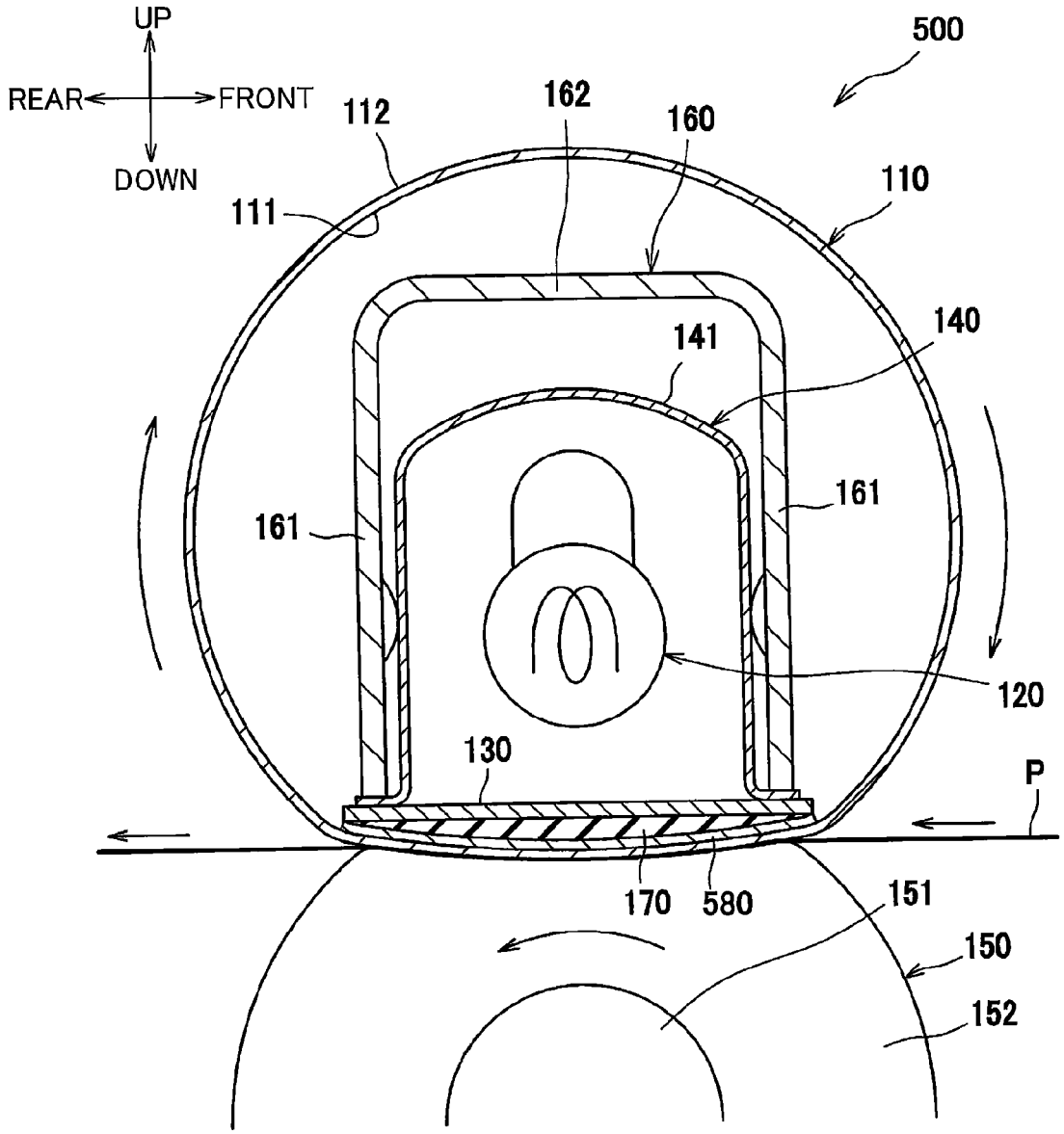
FIG. 6 is a cross-sectional view of a fixing device according to a fifth embodiment.

FIG. 6 shows a fixing device 500 according to a fifth embodiment of the present invention.

The fixing device 500 according to the fifth embodiment includes the nip plate 130 of the first embodiment. The fixing device 500 of the fifth embodiment is different from the fixing device 100 of the first embodiment in that a sliding member 580 is further provided on the lower surface of the rubber layer 170. The sliding member 580 is thus positioned between the rubber layer 170 and the inner peripheral surface 111 of the fixing belt 110.

More specifically, as shown in FIG. 6, the sliding member 580 has a sliding resistance against the fixing belt 110 smaller than that of the rubber layer 170. Here, as the sliding member 580, a coating agent may be applied to the lower surface of the rubber layer 170.

As a result of provision of the sliding member 580 having lower sliding resistance than the rubber layer 170 on the lower surface of the rubber layer 170, smooth circular movement of the fixing belt 110 relative to the sliding member 580 can be realized.

6. Sixth Embodiment

Figure 7:
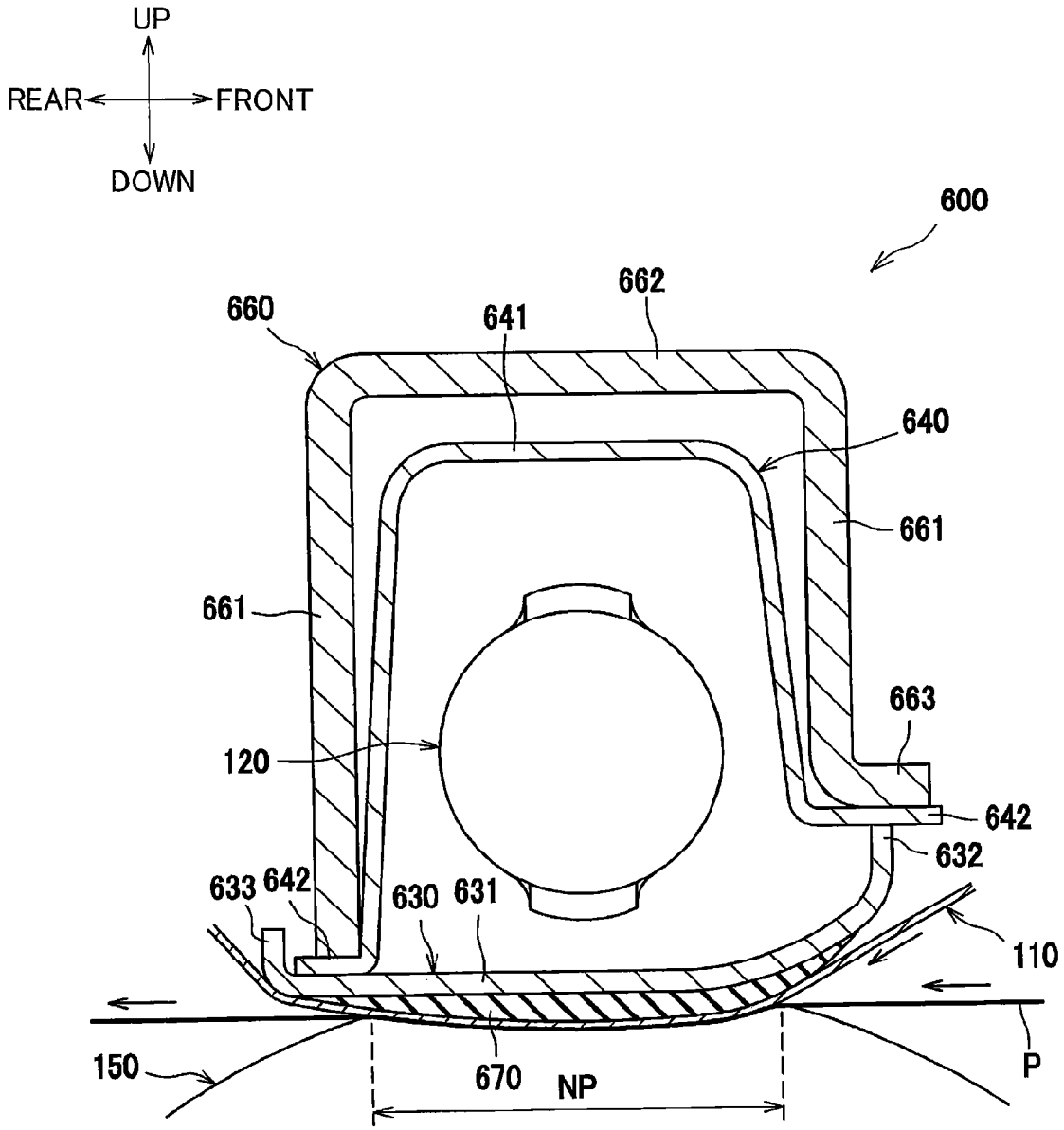
FIG. 7 is a cross-sectional view of a fixing device according to a sixth embodiment.

FIG. 7 shows a fixing device 600 according to a sixth embodiment of the present invention.

The fixing device 600 of the sixth embodiment includes a nip plate 630, a reflection plate 640, and a stay 660.

Specifically, as shown in FIG. 7, the nip plate 630 has a base portion 631, a curved portion 632, and a bent portion 633. The base portion 631 is substantially plate-shaped and extends in a direction orthogonal to the up-down direction. The curved portion 632 extends from a front end portion of the base portion 631 and curves diagonally frontward and upward. The bent portion 633 extends upward from a rear end portion of the base portion 631.

The reflection plate 640 has a reflecting portion 641 and flange portions 642. The reflecting portion 641 is substantially U-shaped with its opening facing downward. The flange portions 642 respectively extend outward in the front-rear direction from front and rear end portions of the reflecting portion 641. The front flange portion 642 is positioned higher than the rear flange portion 642 in the up-down direction. The front flange portion 642 is in contact with an upper end of the curved portion 632 of the nip plate 630, and the rear flange portion 642 is in contact with the rear end portion of the base portion 631 of the nip plate 630.

The stay 660 has a pair of first walls 661 disposed facing each other in the front-rear direction, a second wall 662 connecting between respective upper ends of the first walls 661, and a flange portion 663 protruding frontward from a lower end of the front-side first wall 661. The flange portion 663 supports the upper end of the curved portion 632 of the nip plate 630 via the front flange portion 642 of the reflection plate 640. The rear-side first wall 661 supports the rear end portion of the base portion 631 of the nip plate 630 via the rear flange portion 642 of the reflection plate 640.

The nip plate 630 has a lower surface on which a rubber layer 670 is provided. The rubber layer 670 has substantially the similar structure to that of the rubber layer 170 of the first embodiment. Specifically, the rubber layer 670 is provided to span the base portion 631 and the curved portion 632 in the front-rear direction. The rubber layer 670 thus has a front-rear length longer than that of the nip portion N. The rubber layer 670 has a generally convex shape protruding downward as viewed in the left-right direction (in the widthwise direction of the fixing belt 110). More specifically, the rubber layer 670 has a thickness that is greatest at a central portion thereof in the front-rear direction and that gradually decreases toward downstream and upstream in the sheet conveying direction.

With this structure, similar technical effects as with the first embodiment can be achieved.

7. Seventh Embodiment

Figure 8:
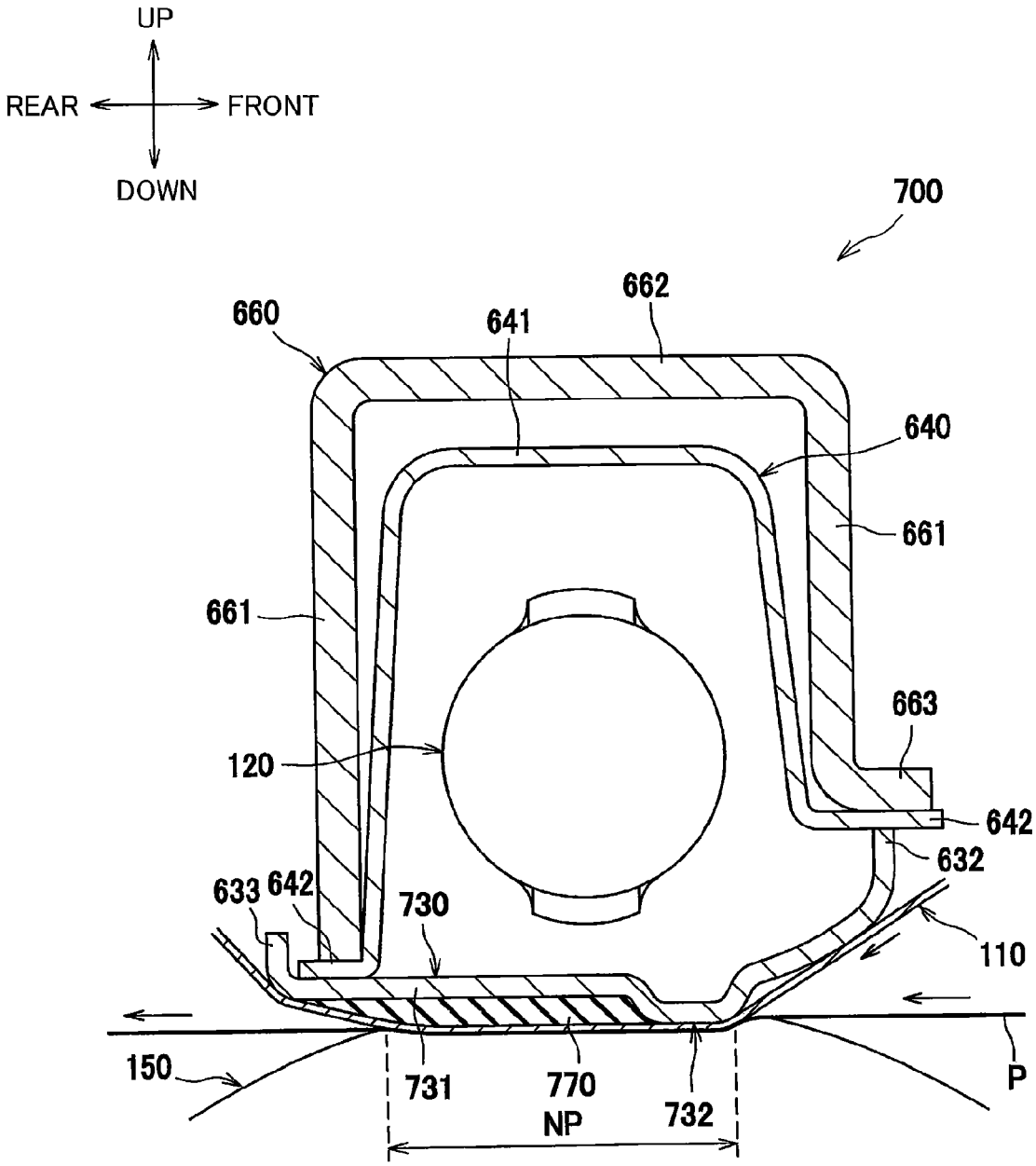
FIG. 8 is a cross-sectional view of a fixing device according to a seventh embodiment.

FIG. 8 shows a fixing device 700 according to a sixth embodiment of the present invention.

The fixing device 700 of the seventh embodiment includes a nip plate 730, the reflection plate 640, and the stay 660. As shown in FIG. 8, the nip plate 730 of the seventh embodiment has: a supporting portion 731 supporting a rubber layer 770; a protruding portion 732; and the curved portion 632 and bent portion 633 of the sixth embodiment. That is, the nip plate 730 is different from the nip plate 630 of the sixth embodiment in that the protruding portion 732 is further provided in the nip plate 730. The supporting portion 731 supporting the rubber layer 770 has substantially similar structure as those of the supporting portion 331 of the third embodiment and the base portion 631 of the sixth embodiment. The supporting portion 731 serves just as the supporting portion 231 of the third embodiment and the base portion 631 of the sixth embodiment. The protruding portion 732 has substantially the same structure as that of the protruding portion 232 of the second embodiment.

The protruding portion 732 is provided at a front end portion of the supporting portion 731. The curved portion 632 is provided to be connected to a front end portion of the protruding portion 732. The protruding portion 732 is positioned upstream of the rubber layer 770 in the moving direction of the fixing belt 110 (or in the sheet conveying direction). The rubber layer 770 has a thickness that gradually decreases toward downstream in the sheet conveying direction. The protruding portion 732 is an example of the first protruding portion.

With provision of the protruding portion 732 and the rubber layer 770 in this way, similar technical effects as with the third embodiment can be achieved.

8. Eighth Embodiment

Figure 9:
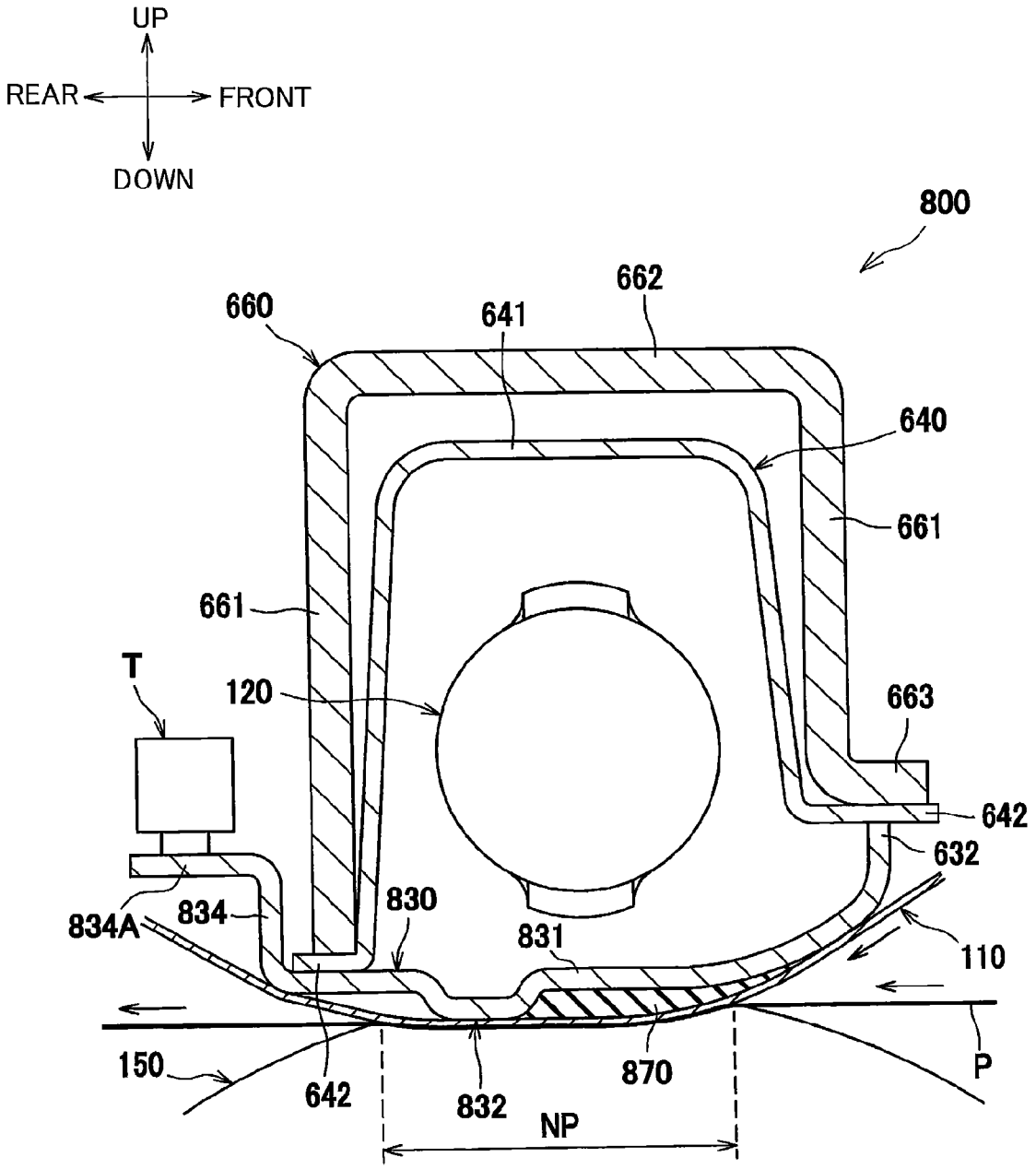
FIG. 9 is a cross-sectional view of a fixing device according to an eighth embodiment.

FIG. 9 shows a fixing device 800 according to an eighth embodiment of the present invention.

The fixing device 800 of the eighth embodiment includes a nip plate 830, the reflection plate 640, and the stay 660. As shown in FIG. 9, the nip plate 830 includes a base portion 831 supporting a rubber layer 870, a protruding portion 832, the curved portion 632 and an extending portion 834. The base portion 831 has generally similar structure as those of the supporting portion 231 of the second embodiment and the base portion 631 of the sixth embodiment. The rubber layer 870 has substantially similar structure as that of the rubber layer 270 of the second embodiment. That is, the rubber layer 870 has a thickness that gradually becomes smaller toward upstream in the sheet conveying direction. The protruding portion 832 has substantially the same structure as that of the protruding portion 232 of the second embodiment.

Unlike the nip plate 730 of the seventh embodiment, the protruding portion 832 is formed in a generally front-rear center portion of the base portion 831 of the nip plate 830. That is, the protruding portion 832 is positioned downstream of the rubber layer 870 in the moving direction of the fixing belt 110 (in the sheet conveying direction). Specifically, the rubber layer 870 is supported by an upstream-side portion of the base portion 831 and a downstream-side portion of the curved portion 632. The upstream-side portion of the base portion 831 and downstream-side portion of the curved portion 632 collectively serve as the supporting portion in the eighth embodiment. The protruding portion 832 is an example of the first protruding portion.

The extending portion 834 is provided in place of the bent portion 633 of the sixth embodiment. The extending portion 834 extends, from a downstream end of the base portion 831, first upward and then generally toward downstream in the sheet conveying direction. The extending portion 834 has a downstream end portion that opposes the temperature detector T. This downstream end portion of the extending portion 834 serves as a detected portion 833A whose temperature is detected by the temperature detector T. That is, the detected portion 833A is positioned downstream of the protruding portion 832 in the moving direction of the fixing belt 110 (sheet conveying direction). Put another way, the detected portion 833A is positioned opposite to the supporting portion supporting the rubber layer 870 (the upstream-side portion of the base portion 831 and downstream-side portion of the curved portion 632) with respect to the protruding portion 832.

With this structure, similar technical effects as with the third embodiment can be achieved.

9. Ninth Embodiment

Figure 10:
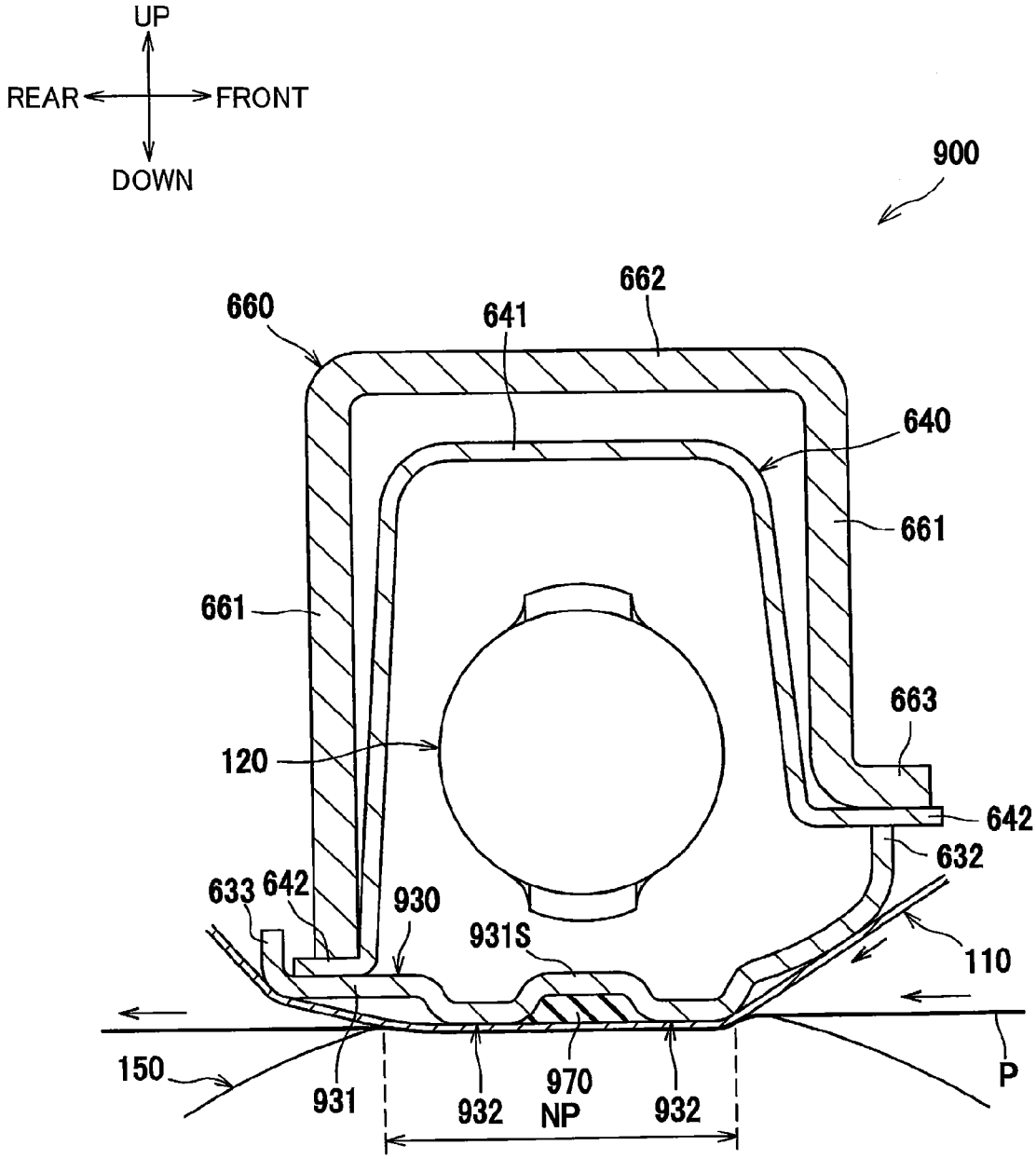
FIG. 10 is a cross-sectional view of a fixing device according to a tenth embodiment.

A fixing device 900 according to a ninth embodiment of the present invention is shown in FIG. 10.

The fixing device 900 includes a nip plate 930, the reflection plate 640, and the stay 660. Specifically, as shown in FIG. 10, the nip plate 930 has: a base portion 931; the curved portion 632 and the bent portion 633 of the sixth embodiment; a pair of protruding portions 932; and a rubber layer 470 interposed between the protruding portions 932. Specifically, the protruding portions 932 are respectively provided in a front end portion and a generally central portion of the base portion 931 such that a portion of the base portion 931 interposed between the two protruding portions 932 constitutes a supporting portion 931S for supporting the rubber layer 970. This supporting portion 931S supporting the rubber layer 970 has substantially the same structure as that of the supporting portion 431 of the fourth embodiment. The curved portion 632 is positioned frontward of the front protruding portion 932. The bent portion 633 is positioned downstream of the base portion 931 in the sheet conveying direction as in the sixth embodiment. The protruding portions 932 are example of the first protruding portion and the second protruding portion.

With this structure, similar technical effects as with the fourth embodiment can be achieved.

Various modifications are conceivable.

In the embodiments described above, the present invention is applied to the fixing device 100-900 where heat from the halogen lamp 120 is transmitted to the fixing belt 110 via the nip plate 130-930. However, the present invention is not limited to this configuration.

Figure 11:
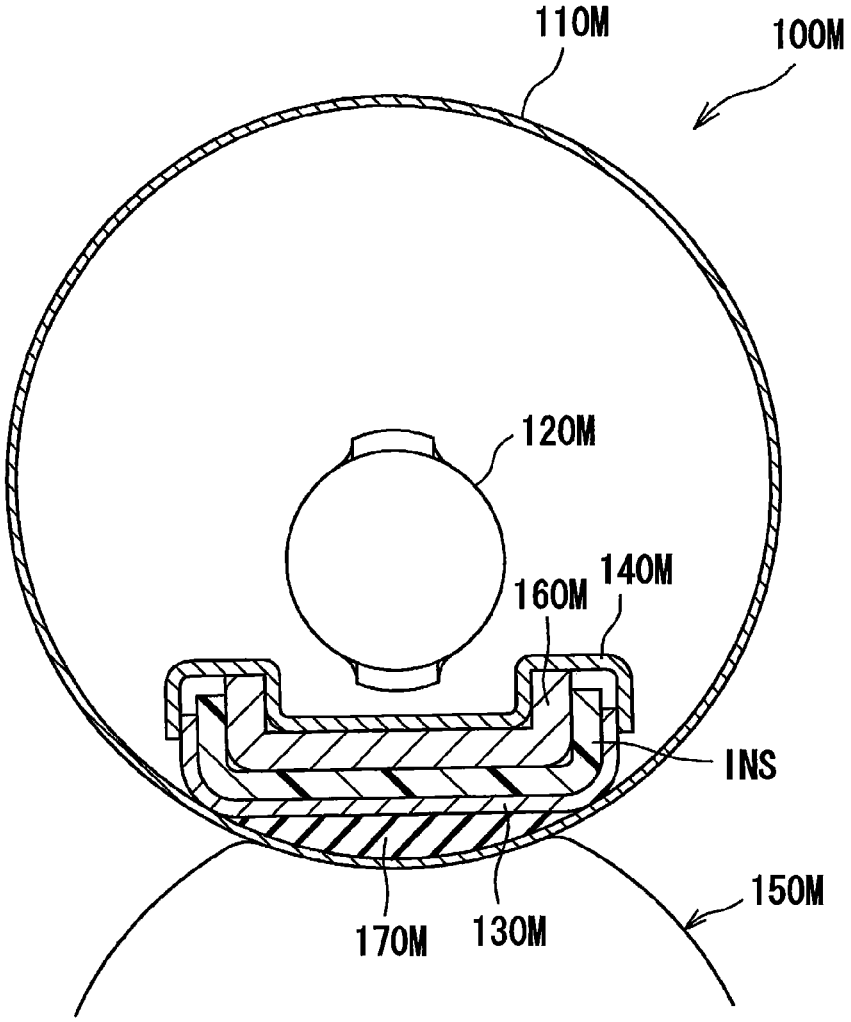
FIG. 11 is a schematic cross-sectional view of a fixing device according to a variation of the present invention, wherein heat from a heater is transmitted directly to a fixing belt.

FIG. 11 shows a fixing device 100M according to a variation of the present invention. In the fixing device 100M, heat is transmitted directly from a halogen lamp 120M to a fixing belt 110M.

Specifically, the fixing device 100M includes: the fixing belt 110M, the halogen lamp 120M, a pressure roller 150M, a nip plate 130M, a stay 160M, a reflecting member 140M, a heat insulating member INS, and a rubber layer 170M.

The nip plate 130M is disposed to oppose the pressure roller 150 with the fixing belt 110 nipped therebetween. The heat insulating member INS is provided on an upper surface of the nip plate 130M. The stay 160M supports the nip plate 130M with the heat insulating member INS interposed therebetween. The reflecting member 140M is provided at an upper surface of the stay 160M. The rubber layer 170M is provided between the nip plate 130M and an inner peripheral surface of the fixing belt 110M. The rubber layer 170M has substantially the same structure as the rubber layer 170 of the first embodiment. With this configuration as well, the similar technical effects as with the first embodiment can be obtained.

In this variation, the nip plate 130M is provided with the rubber layer 170M. Thus, heat transfer from the fixing belt 110M to the nip plate 130M is unlikely to occur, thereby realizing a rapid increase in temperature of the fixing belt 110.

Still other variations and modifications are conceivable.

For example, as the elastic layer of the present invention, a material other than rubber, such as fluororesin may be available. Still alternatively, the thickness of the rubber layer may be constant in the sheet conveying direction (moving direction of the fixing belt 110), instead of the depicted configuration in which the thickness of the elastic layer gradually decreases toward upstream and/or downstream in the sheet conveying direction.

In the depicted embodiments, the halogen lamp 120 is employed as an example of the heater. However, an infrared ray heater or carbon heater is available instead of the halogen lamp 120.

The plate-like shaped nip plate 130-930 is employed as an example of the nip member of the present embodiment in the depicted embodiments. However, the nip member may have another form other than the plate-like shape with a sufficient thickness.

Further, the pressure roller 150 is used as an example of a backup member in the depicted embodiments. However, a belt like pressure member is also available.

While the invention has been described in detail with reference to the embodiments thereof, it would be apparent to those skilled in the art that various changes and modifications may be made therein without departing from the spirit of the invention.

What is claimed is:

1. A fixing device comprising:

a tubular endless belt having an inner peripheral surface defining an internal space and configured to circularly move in a moving direction;

a heater disposed in the internal space and configured to generate radiant heat;

a nip member disposed in the internal space and spaced away from the heater;

an elastic layer fixed on the nip member and positioned between the nip member and the inner peripheral surface of the tubular endless belt; and a backup member, the backup member and the nip member being configured to nip the tubular endless belt therebetween to provide a nip region between the backup member and the nip member, wherein the nip member includes:

a supporting portion supporting the elastic layer; and a first protruding portion connected to the supporting portion and protruding toward the backup member, and wherein the elastic layer has a first surface configured to be in contact with the inner peripheral surface of the tubular endless belt and a second surface opposite to the first surface and supported by the supporting portion, the elastic layer being in contact with the first protruding portion in the moving direction of the tubular endless belt, the first protruding portion of the nip member and the first surface of the elastic layer constituting the nip region in cooperation with the backup member.

2. The fixing device as claimed in claim 1, wherein the first protruding portion is positioned upstream of the elastic layer in the moving direction.

3. The fixing device as claimed in claim 2, wherein the elastic layer has a thickness that gradually decreases toward downstream in the moving direction.

4. The fixing device as claimed in claim 1, wherein the first protruding portion is positioned downstream of the elastic layer in the moving direction.

5. The fixing device as claimed in claim 4, wherein the elastic layer has a thickness that gradually decreases toward upstream in the moving direction.

6. The fixing device as claimed in claim 1, further comprising a temperature detector configured to detect a temperature of the nip member, wherein the nip member further includes a detected portion whose temperature is configured to be detected by the temperature detector, the detected portion being positioned opposite to the supporting portion with respect to the first protruding portion.

7. The fixing device as claimed in claim 6, wherein the temperature detector is disposed on the detected portion of the nip member.

8. The fixing device as claimed in claim 1, wherein the nip member further includes:

a second protruding portion connected to the supporting portion and protruding toward the backup member, wherein the elastic layer is positioned between the first protruding portion and the second protruding portion in the moving direction.

9. The fixing device as claimed in claim 1, wherein the tubular endless belt has a width in a widthwise direction; and wherein the first surface has an arcuate shape as viewed in the widthwise direction of the tubular endless belt.

10. The fixing device as claimed in claim 1, wherein the tubular endless belt has a width in a widthwise direction, and wherein the elastic layer has a width larger than that of the backup member in the widthwise direction of the tubular endless belt.

11. The fixing device as claimed in claim 1, further comprising a sliding member provided on the elastic layer and positioned between the elastic layer and the inner peripheral surface of the tubular endless belt, the sliding member having a sliding resistance against the tubular endless belt smaller than that of the elastic layer.

12. The fixing device as claimed in claim 1, wherein the inner peripheral surface of the tubular endless belt is applied with a lubricant.

13. The fixing device as claimed in claim 1, wherein the elastic layer is a rubber layer.

14. The fixing device as claimed in claim 1, wherein the elastic layer has a thickness that gradually decreases toward upstream in the moving direction.

15. The fixing device as claimed in claim 1, wherein the first protruding portion of the nip member has a length larger than a length of the first surface of the elastic layer in the moving direction.

16. The fixing device as claimed in claim 1, wherein the first protruding portion includes a contact surface configured to be in contact with the inner peripheral surface of the tubular endless belt and a connecting surface extending from the contact surface and connected to the supporting portion, the elastic layer being in contact with the connecting surface of the first protruding portion in the moving direction of the tubular endless belt, and wherein the contact surface of the first protruding portion and the first surface of the elastic layer are continuously connected to each other to constitute the nip region in cooperation with the backup member.

17. The fixing device as claimed in claim 1, further comprising a stay disposed in the internal space and supporting the nip member, wherein the nip member is made of a material having a thermal conductivity higher than a thermal conductivity of the stay.

18. A fixing device comprising:

an endless belt having an inner peripheral surface and configured to circularly move in a moving direction;

a heater;

a nip member spaced away from the heater and comprising:

a base layer; and an elastic layer fixed on the base layer, the elastic layer being in contact with the endless belt; and a backup member, the backup member and the nip member nipping the endless belt therebetween to form a nip region between the backup member and the nip member, wherein the base layer includes:

a supporting portion supporting the elastic layer; and a first protruding portion connected to the supporting portion and protruding toward the backup member, and wherein the elastic layer has a first surface configured to be in contact with the inner peripheral surface of the endless belt and a second surface opposite to the first surface and supported by the supporting portion, the elastic layer being in contact with the first protruding portion in the moving direction of the endless belt, the first protruding portion of the base layer and the first surface of the elastic layer constituting the nip region in cooperation with the backup member.

19. The fixing device as claimed in claim 18, wherein the base layer of the nip member further includes a second protruding portion connected to the supporting portion and protruding toward the backup member, and wherein the elastic layer is positioned between the first protruding portion and the second protruding portion.

* * * * *